United States Patent [19]

Guscott et al.

[11] Patent Number: 4,875,029

[45] Date of Patent: Oct. 17, 1989

[54] SUPPRESSED TRANSIENT UNIFORM DETECTION SENSITIVITY PIR DETECTOR

[75] Inventors: John K. Guscott, Lynnfield; Gerard G. Stelmack, Newton; Charles A. Boulos, Milford, all of Mass.

[73] Assignee: Aritech Corporation, Framingham, Mass.

[21] Appl. No.: 139,652

[22] Filed: Dec. 30, 1987

[51] Int. Cl.[4] ..... G08B 13/18

[52] U.S. Cl. ..... 340/567; 250/338.3; 250/340; 250/342

[58] Field of Search ..... 340/567; 250/338.3, 250/342, 340

[56] References Cited

U.S. PATENT DOCUMENTS

| | | | |
|---|---|---|---|
| 4,179,691 | 12/1979 | Keller | 340/567 |
| 4,501,967 | 2/1985 | Shaulov | 250/338.2 |
| 4,612,442 | 9/1986 | Toshimichi | 250/353 |

*Primary Examiner*—Glen R. Swann, III

*Attorney, Agent, or Firm*—Weingarten, Schurgin, Gagnebin & Hayes

[57] ABSTRACT

A passive analog equalizer is connected to the output of an infrared detector to provide increasing pyroelectric detector sensitivity with increasing target frequency in order to provide a detection sensitivity which is substantially flat over the target velocity range of interest. An interruptable modulator is connected to the equalized pyroelectric detector signal to shift its frequency upwardly in order to provide negligible drift, fast recovery from transients, and the ability to quickly shut down the modulator when a transient occurs. A transient detector is operative in response to transients in the pyroelectric detector output signal to provide a window during which the modulator is interrupted in order to prevent transient induced false alarms.

11 Claims, 4 Drawing Sheets

SUPPRESSED TRANSIENT UNIFORM DETECTION SENSITIVITY PIR DETECTOR

BACKGROUND OF THE INVENTION

This invention is directed to the field of radiant energy detection, and more particularly, to a suppressed transient, uniform detection sensitivity passive infrared detector.

BACKGROUND OF THE INVENTION

The utility of the heretofore known passive infrared detection systems is limited by transient phenomena, which induce false alarms, and by a detector output that is velocity dependent, which imposes a non-uniform detection sensitivity with target velocity. Such phenomena as static, lightning, radio frequency energy and mechanical shock, among others, produce momentary processing circuitry responses, which are detected, and false alarms are therebecause produced.

The faster the target is moving, the lower the voltage produced by the infrared detecting element. For a typical pyroelectric detector frequency response, a 20 dB/decade rolloff from a 3 dB point at about 0.3 Hz provides detector output at levels that diminish with increasing target speeds. The detection sensitivity thus varies with target velocity in a way that accentuates low frequency detection over that of comparatively higher frequency detection, thereby giving rise to undesirable failure of alarm situations.

SUMMARY OF THE INVENTION

The present invention discloses as one of its objects a passive infrared detector that is substantially immune to false alarming from transients occurring in and around the detector. Means are disclosed for detecting transients and for interrupting the alarm processing in response to transient detection to prevent the transients from being detected and thereby providing a false alarm. The alarm processing is interrupted just long enough to ensure that each particular transient has decayed in order to minimize gaps in the surveillance of the protected region. The interrupting means in the preferred embodiment includes a disablable fast recovery modulator connected in the input signal channel that is disabled upon detection of a transient for a time interval just long enough to accommodate the time for transient decay.

According to another object of the present invention, a uniform detection sensitivity passive infrared receiver is disclosed. An equalizer is connected in the infrared detector processing channel to selectively accentuate higher frequency components while simultaneously suppressing lower frequency components in such a way that a substantially flat frequency response is provided over the frequencies of interest for infrared detection. The equalizer in the preferred embodiment is an analog resistive capacitive network and buffer that exhibits approximately a 4 dB amplitude variation over the frequency range of interest, while a conventional passive infrared detector would show a variation of well over 10 dB.

BRIEF DESCRIPTION OF THE DRAWINGS

These and other objects, advantages, and aspects of the Present invention will become apparent as the invention becomes better understood by referring to the detailed description of the preferred embodiment, as well as to the drawings, wherein.

DETAILED DESCRIPTION OF THE PREFERRED EMBODIMENT

Figure 1:
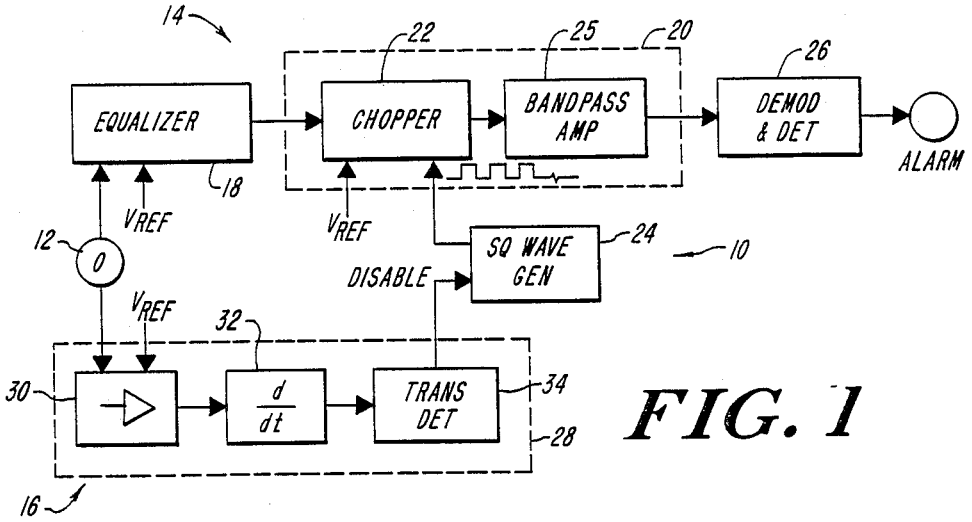
FIG. 1 is a block diagram of the novel infrared detector of the present invention.

Referring now to FIG. 1, generally designated at 10 is a block diagram of the novel suppressed transient uniform detection sensitivity passive infrared receiver according to the present invention. A passive infrared sensor 12 of well known type is operative in response to infrared energy in its operative locale to provide a signal at the output thereof. The signal is processed simultaneously in a first alarm information processing channel generally designated 14 and in a transient detecting channel generally designated 16. An.equalizer 18, to be described, in the alarm information processing channel is operative to attenuate lower frequency components and to accentuate higher frequency components so as to provide a substantially flat frequency response over the range of target velocities of interest. The equalizer is passive, and includes a buffer arrangement.

The target-velocity-compensated signal is processed in an interruptable modulator illustrated by a dashed box 20. The modulator 20 includes a chopper 22, to be described, driven by a square wave generator 24. The chopper 22 modulates the target-velocity-compensated signal providing a signal spectrum shifted to the center frequency of the square wave generator 24. A fast recovery bandpass amplifier 25 to be described recovers the alarm information and suppresses the frequency of the square wave generator 24.

A demodulator and detector 26, to be described, is responsive to the target-velocity-compensated and frequency shifted signal to provide an alarm output signal in the event of intruder motion in the region of the sensor 12 sensitivity.

The transient detecting channel 16 includes transient detection circuitry illustrated in dashed outline 28. The transient detection circuitry 28 includes a preamplifier 30 to be described having a wide bandwidth for amplifying the infrared sensor signal. A differentiator 32, to be described, differentiates the amplified signal to provide a sharply delineated output signal representative of the occurrence of a superposed transient in the incoming infrared sensor output signal. A transient detector 34 to be described responds to the signal representative of a transient in the infrared sensor output signal and produces a window pulse which disables the square wave generator 24, and therewith the interruptable modulator 20, for an interval just long enough to assure that the transient decays. During this interval, the effect of the transient on the output alarm processing is effectively eliminated, so that transient-free uniform-sensitivity intruder detection is thereby accomplished. The duration of the window represents a small portion of the overall processing time, in the preferred embodiment the window lasts for 100 milliseconds, so that the instant suppressed transient uniform detection sensitivity passive infrared receiver exhibits a minimized failure of surveillance, thereby providing a high confidence level alarm output signal.

Figure 2A:
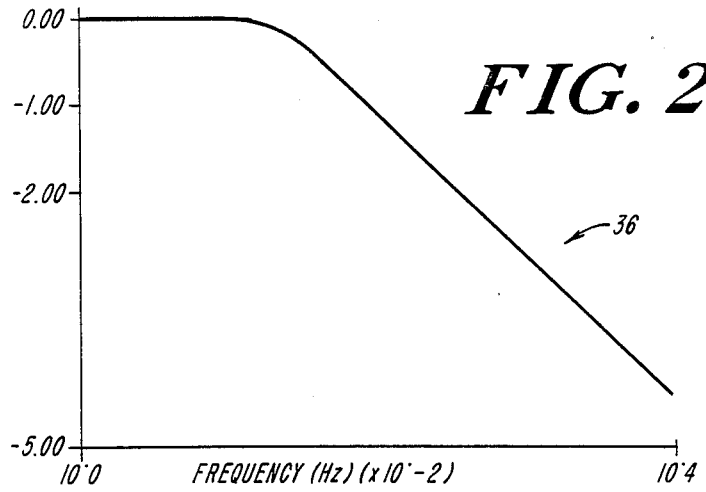
FIG. 2 shows in FIGS. 2A through 2C thereof graphs useful in explaining the operation of the analog equalizer of the present invention.
Figure 2B:
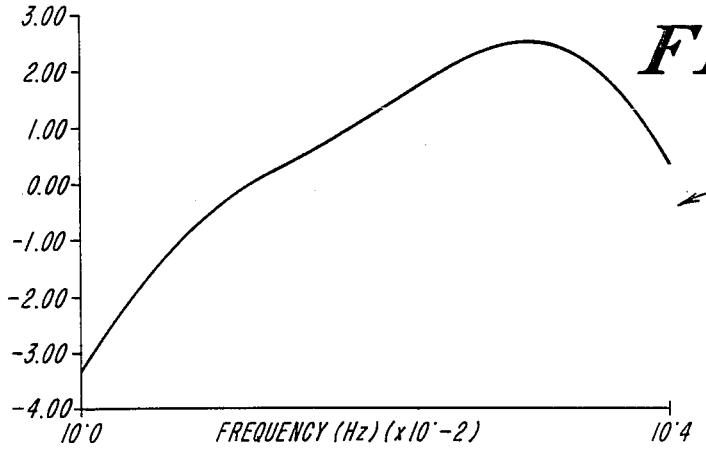
Figure 2C:
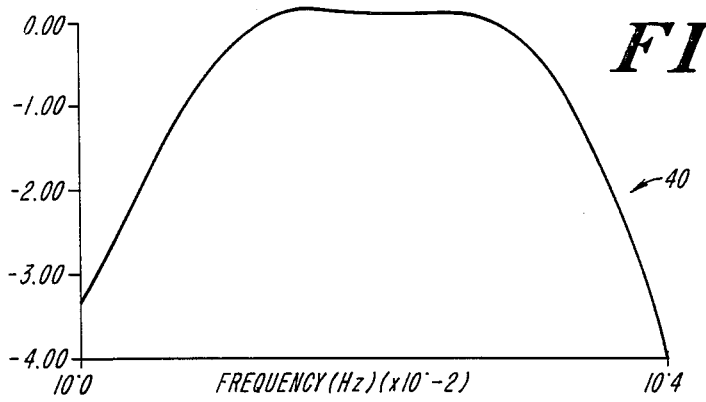

Referring now to FIG. 2, generally designated at 36 in FIG. 2A, 38 in FIG. 2B and 40 in FIG. 2C are graphs useful in explaining the operation of the equalizer 18 (FIG. 1). The graph 36 in FIG. 2A illustrates the relative output of a typical pyroelectric detector with input frequency. As will be appreciated, the input frequency corresponds to target velocity in the operative locale of the pyroelectric detector. The desired range of target velocity is about 0.5 to 10 feet per second, which corresponds to a frequency range of about 0.07 to 1 Hz. The response rolls off at a 20 dB/decade rate from a 3 dB at about 0.3 Hz, thus providing decreasing sensitivity with increasing velocity.

The graph 38 in FIG. 2B illustrates the response of the equalizer 18 over the same range of the frequency input. The equalizer provides increased attenuation at lower frequencies and comparatively higher gain at the higher frequencies. The equalizer thus provides increasing sensitivity with increasing frequency velocities.

The graph 40 in FIG. 2C illustrates the composite frequency response of the equalizer when driven by an input signal of the form of the curve 36 in FIG. 2A. The sensitivity is considerably flattened with respect to that of the graph 36 in FIG. 2A, and exhibits an amplitude variation of about 4 dB over the frequency range of interest, while a conventional passive infrared receiver would show a variation in excess of 10 dB.

Figure 3:
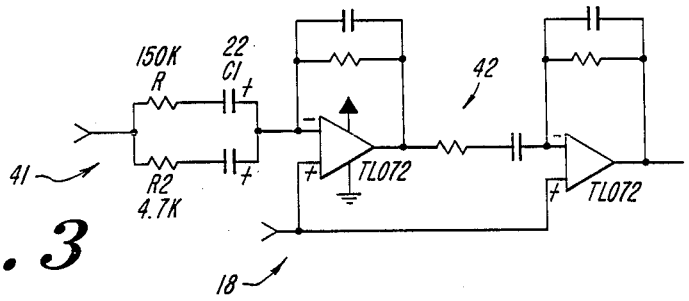
FIG. 3 is, a schematic diagram of the analog equalizer.

Referring now to FIG. 3, generally designated at 39 is a schematic diagram of the equalizer 18 (FIG. 1) in the presently Preferred embodiment. The equalizer 39 includes an input network generally designated 41 of parallel series arranged RC networks R1, C1, R2, C2 with the values indicated. The network 41 Provides the equalization depicted in graphic form at 40 in FIG. 2C. The equalized sensor output signal is then passed through a buffer generally designated 42 that consists of the illustrated two-stage opamp arrangement, although other circuits are possible.

Figure 4:
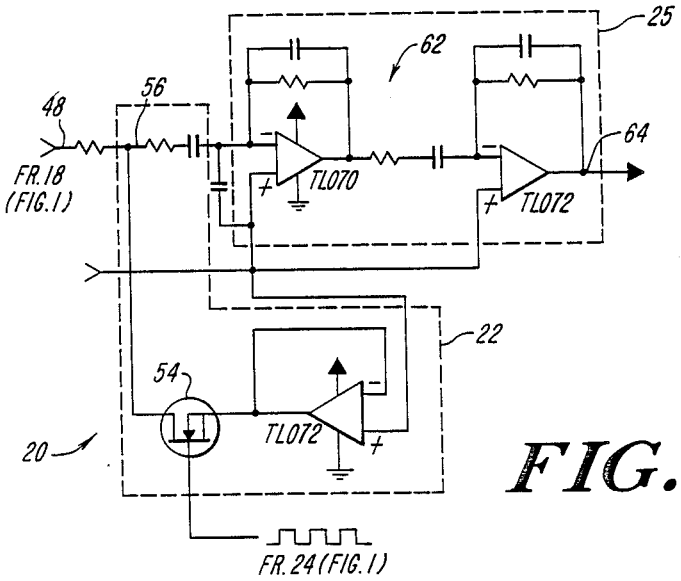
FIG. 4 is a schematic diagram illustrating the interruptable modulator in the infrared signal alarm processing channel of the present invention.
Figure 5A:
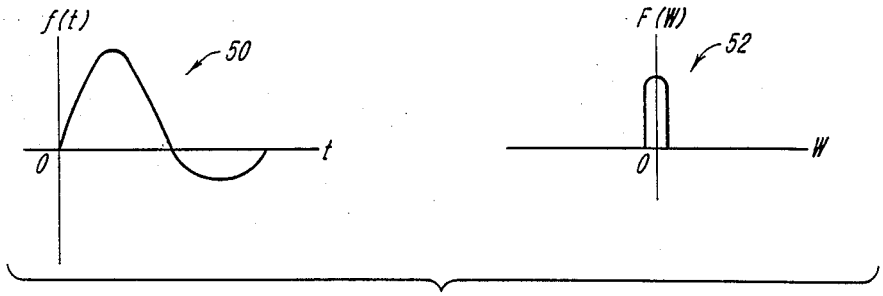
FIG. 5; illustrates in FIGS. 5A, 5B, and 5C thereof frequency and time domain graphs useful in explaining the operation of the interruptable modulator of FIG. 4.
Figure 5B:
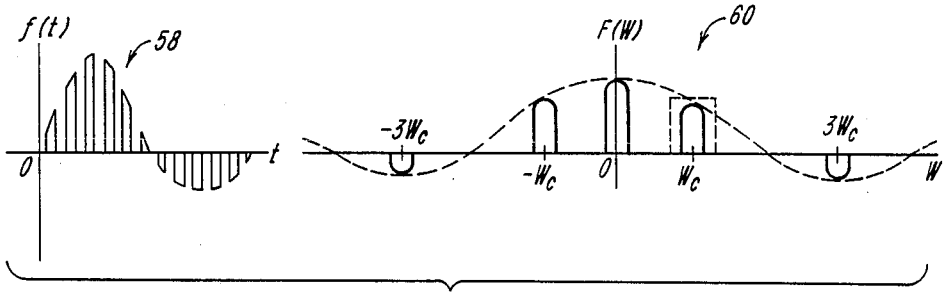

The interruptable modulator 20 (FIG. 1) is shown in schematic circuit form generally designated 46 in FIG. 4. The equalized pyrodetector output signal appearing on line 48 is generally designated at 50 in the time domain and is generally designated at 52 in the frequency domain in FIG. 5A. An analog switch 54, preferrably having a 50% duty cycle driving waveform, is gated by the chopper signal produced by the square wave generator 24 in FIG. 1 so as to draw the input signal appearing on the line 48 to the reference voltage every half cycle. The resulting signal appearing on the line 56 is generally designated at 58 in the time domain and is generally designated at 60 in the frequency domain in FIG. 5B. The chopper effectively shifts the frequency of the equalized detector output signal and centers it about the frequency of the square wave generator. Processing of the frequency shifted signal makes possible high bandwidth processing. In this way, transients are suppressed using high speed circuitry before they propagate through the electronics of the alarm information processing channel so that false alarms are thereby substantially eliminated. Operation at this higher bandpass frequency range provides fast recovery from interruption due to transient detection, thereby substantially eliminating false alarms and lengthy restabilization in response to a transient.

Figure 5C:
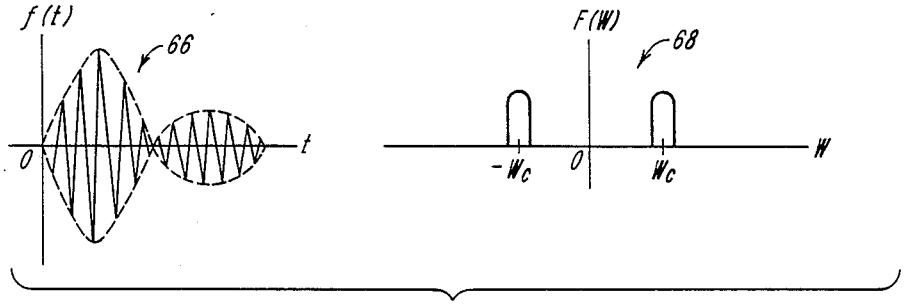

A fast-recovery-time high speed bandpass amplifier 25, which consists of the two illustrated high gain serially coupled opamp stages generally designated 62, is connected to receive the frequency shifted signal. The bandpass amplifier both amplifies the amplitude of the equalized and frequency shifted signal, 60 dB in the preferred embodiment, and eliminates the unnecessary Portion of the modulated spectrum. The waveform at the circuit Point 64 is generally designated 66 in the time domain and 68 in the frequency domain in FIG. 5C.

Figure 6:
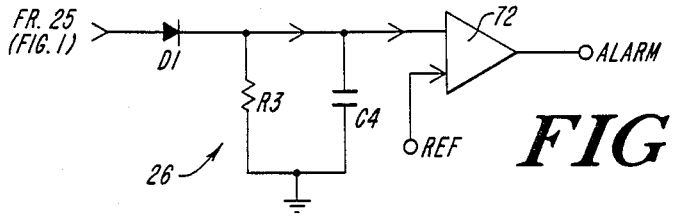
FIG. 6,,is a schematic diagram of a demodulator circuit.

The modulator and detector 26 (FIG. 1) is generally designated in circuit diagram form at 70 in FIG. 6. The demodulator includes an envelope detector consisting of the diode D1 and the parallel resistor R3 capacitor C4 combination. On the Positive half cycle of the bandpass amplifier output, the diode D1 conducts, allowing the capacitor C4 to charge up to the signal peak voltage. As the signal falls below this value, the diode becomes reverse biased and the capacitor slowly discharges through the parallel resistor R3 until the next positive half cycle causes the process to repeat. The time constant of the discharge network is chosen such that squarewave frequency ripple is balanced against an overly sluggish response. The envelope detected signal is a full wave rectified version of the input signal, and is detected by a single-level comparator 72, which triggers an alarm whenever the amplitude exceeds the predetermined alarm threshold.

Figure 7:
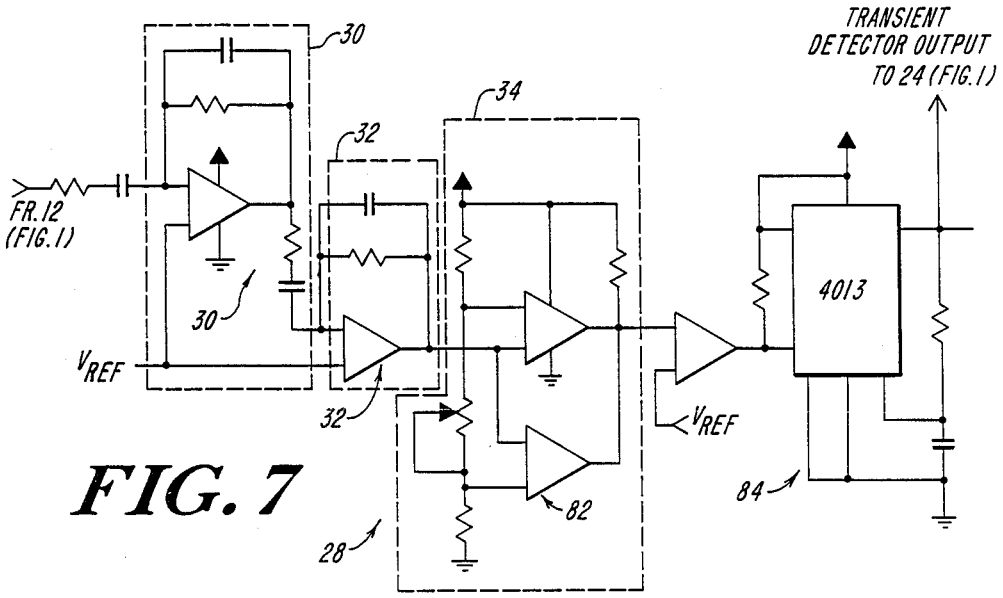
FIG. 7 is a schematic diagram of the transient detector circuit of the present invnetion.

The transient detector circuit 28 (FIG. 1) is generally designated in circuit diagram form at 74 in FIG. 7. The transient detector circuit includes a wide bandwidth preamplifier circuit generally designated 78. The amplifier 78 includes an opamp that, in the preferred embodiment, has from a one to a fifteen kilohertz bandwidth. The amplified signal is differentiated by a differentiator circuit generally designated 80 to emphasize the fast transition time characteristic of transients. The differentiated and amplified signal is then fed through a window comparator circuit generally designated 82. The window comparator produces an output signal whenever the differentiated signal is outside its prescribed bounds. A one-shot generally designated 84 is operatively coupled to the output of the window comparator 82. The one-shot 84 responds to a detected transient to provide a pulse or a window of a fixed duration, which pulse is used to disable the square wave generator 24 (FIG. 1). The duration of the window provided by the one-shot 84 is preferrably on the order of 100 milliseconds.

The transient-detector-driven interruptable modulator effectively eliminates transient-induced false alarms. The transient detector responds fast enough to shut down the bandpass amplifier. Since the bandpass amplifier is operating at a relatively high frequency, it recovers quickly in response to a transient. The overall passive infrared receiver system of the invention thus needs to be shut down only very briefly when a transient is detected. This greatly increases false alarm immunity while maintaining a high level of detection integrity.

Figure 8:
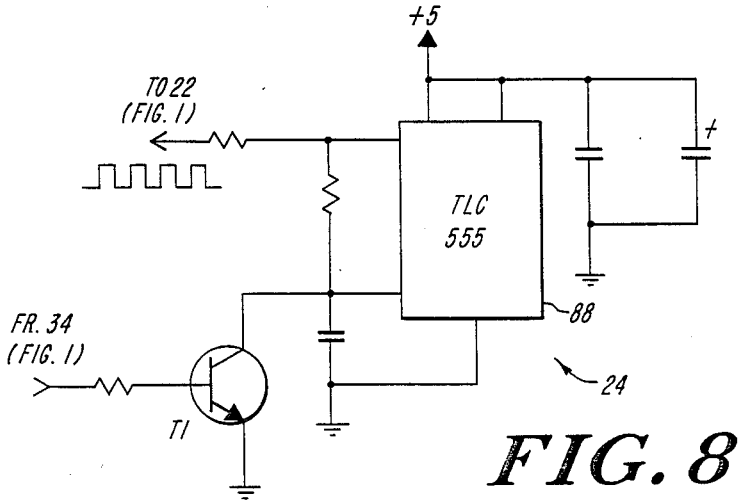
FIG. 8 is a schematic diagram illustrating a circuit responsive to the detection of a transient to interrupt the interruptable modulator for a time sufficient to allow transient decay and just so long as to minimize gaps in surveillance according to the present invention.

Referring now to FIG. 8, generally designated at 86 is a schematic circuit diagram of the square wave generator 24 (FIG. 1). The square wave generator 86 in the preferred embodiment provides a stable, 50% duty cycle square wave as the modulating signal. The square wave generator 86 includes a timer 88 that is selectively disablable by driving it, via the transistor T1, by the output of the pulse transient detector 28 (FIG. 1). In this manner, the chopper 22 (FIG. 1) can be shut down quickly in response to the detection of a transient by the transient detector. During shutdown, the transient cannot be erroneously detected and false alarms are thereby eliminated.

Many modifications of the presently disclosed invention will become apparent to those skilled in the art without departing from the inventive concept.

What is claimed is:

1. A uniform-detection-sensitivity passive infrared detector, comprising:

infrared sensor means for providing a target detection signal having an amplitude that diminishes with increasing target velocity over a range of detectable target velocities, said infrared sensor means including a pyroelectric detector; and equalizer means coupled to the infrared sensor means for increasingly boosting the amplitude of the target detection signal with increasing target velocity so as to provide a target-velocity-compensated signal that is substantially flat over the range of detectable target velocities;

said equalizer means including an analog passive network having a resistor capacitor network.

2. A uniform-detection-sensitivity passive infrared detector, comprising:

infrared sensor means for providing a target detection signal having an amplitude that diminishes with increasing target velocity over a range of detectable target velocities; and equalizer means coupled to the infrared sensor means for increasingly boosting the amplitude of the target detection signal with increasing target velocity so as to provide a target-velocity-compensated signal that is substantially flat over the range of detectable target velocities;

said target-velocity-compensated signal having a frequency domain spectrum, and further including means for shifting said frequency domain spectrum upwardly in frequency to provide a frequency shifted target-velocity-compensated-signal.

3. The detector of claim 2, wherein said frequency domain spectrum shifting means includes a modulator.

4. The detector of claim 3, wherein said modulator includes a square wave chopper having a center frequency, and a fast recovery bandpass amplifier centered about the center frequency of the square wave chopper.

5. The detector of claim 2, further including means coupled to said infrared sensor means for detecting transients in said target detection signal; means responsive to said frequency shifted target-velocity-compensated signal for providing an alarm; and means coupled to the transient detecting means and to said alarm providing means for interrupting the alarm providing means for a preselected time whenever said transient detecting means detects a transient.

6. The detector of claim 5, wherein said preselected time is selected to be just so long as a nominal transient decay time thereby minimizing gaps in alarm surveillance.

7. A suppressed transient infrared detector for a protected region, comprising:

means for sensing infrared radiation;

means for discriminating transients in the sensed infrared radiation;

means for providing an alarm in response to sensing infrared radiation; and means for inhibiting the alarm providing means in response to discrimination of transients in the sensed infrared radiation for a preselected time window selected to both minimize false alarms as well as to minimize gaps in region surveillance.

8. The detector of claim 7, wherein the sensing means further includes means for providing a signal at a first bandwidth in response to sensing radiation, and further includes means for shifting said first bandwidth signal upwardly in frequency to a comparatively higher bandwidth, wherein said discriminating means further includes means for producing a discrimination signal in response to discriminating transients, and wherein said alarm providing means further includes means for providing an alarm signal in response to said comparatively higher bandwidth signal, said inhibiting means further includes means for interrupting said comparatively higher bandwidth signal to said alarm signal providing means in response to said discrimination signal.

9. The detector of claim 8, wherein said shifting means includes a square wave chopper for modulating the signal at a first bandwidth to said comparatively higher bandwidth, and a bandpass amplifier centered on said comparatively higher bandwidth signal.

10. The detector of claim 9, wherein the transient discriminating means includes a differentiator operative to produce a well-defined pulse in response to transients in the sensed infrared radiation.

11. The detector of claim 10, wherein said interrupting means includes means for providing a window in response to said well-defined pulse during the time interval of which said alarm signal providing means is interrupted.

* * * * *